US007383643B2

(12) United States Patent
Blankenship et al.

(10) Patent No.: US 7,383,643 B2
(45) Date of Patent: Jun. 10, 2008

(54) METHOD FOR DRYING VENEERS

(75) Inventors: Timothy Blankenship, Kane, PA (US); Junius Himes, Smethport, PA (US); Brent Lillesand, Madison, WI (US); James Todd, Ludlow, PA (US); Edward Constantine, Coraopolis, PA (US)

(73) Assignee: Apollo Hardwoods Company, Coraopolis, PA (US)

( * ) Notice: Subject to any disclaimer, the term of this patent is extended or adjusted under 35 U.S.C. 154(b) by 300 days.

(21) Appl. No.: 11/088,226

(22) Filed: Mar. 23, 2005

(65) Prior Publication Data

US 2005/0217136 A1 Oct. 6, 2005

Related U.S. Application Data

(60) Provisional application No. 60/555,884, filed on Mar. 24, 2004.

(51) Int. Cl.
*F26B 5/04* (2006.01)

(52) U.S. Cl. ..... 34/406

(58) Field of Classification Search ..... 34/406
See application file for complete search history.

(56) References Cited

U.S. PATENT DOCUMENTS

| | | | | |
|---|---|---|---|---|
| 3,271,874 | A | 9/1966 | Oppenheimer | |
| 3,474,544 | A | 10/1969 | Holden, Jr. et al. | |
| 4,146,973 | A | 4/1979 | Steffensen et al. | |
| 4,215,489 | A | 8/1980 | McMahon, Jr. | |
| 4,428,128 | A | 1/1984 | Coulson et al. | |
| 4,439,930 | A | 4/1984 | McMahon, Jr. | |
| 2005/0230639 | A1* | 10/2005 | Ancona et al. | 250/455.11 |

* cited by examiner

*Primary Examiner*—S. Gravini
(74) *Attorney, Agent, or Firm*—The Webb Law Firm

(57) ABSTRACT

An apparatus and method is provided to dry veneer or other items by vaporization of moisture in the item. Apparatus has an insulated chamber with a frame and a drawer with a door. A mesh surface of the drawer supports item for drying with a heater at sub-atmospheric pressure inside of the chamber. Item is placed on the layer of mesh of the drawer of the apparatus and secured with fasteners such as another layer of mesh. The drawer with fastened item is placed into the chamber of the apparatus. With the drawer fully engaged within the chamber, the drying apparatus is closed with an airtight seal. A pump draws a vacuum in the chamber and heat is directed at the item to raise the temperature of the item to less than 160° F., particularly between 120° F. to 150° F. Apparatus can dry veneer in less than five minutes.

6 Claims, 5 Drawing Sheets

METHOD FOR DRYING VENEERS

CROSS REFERENCE TO RELATED APPLICATIONS

This application claims the benefit of U.S. Provisional Application No. 60/555,884 entitled "Method and Apparatus for Drying Materials Including Veneers" filed Mar. 24, 2004, which is incorporated herein by reference.

BACKGROUND OF THE INVENTION

1. Field of the Invention

The present invention relates to an apparatus and method of use thereof for drying materials, such as veneer, including a chamber at sub-atmospheric pressure with an internal heating source.

2. Description of Related Art

Traditional prior art veneer dryers use heat from a variety of sources to dry pieces of veneer or other panel materials moving through the dryers on conveyors at high temperatures and high velocities. For example, U.S. Pat. No. 3,474,544 to Holden Jr., et al. discloses a method and apparatus for changing the moisture content of veneer. By way of a conveyor system, veneer is fed at velocities of 30 to 50 mph through multiple treatment areas of the apparatus for heat treatment by high-frequency infrared, microwave or dielectric energy at temperatures between 350° F.-2300° F. Holden Jr. et al. sought to address the effect of warping as veneer was drying under older drying methods. However, in accord with the prior art dryer, the veneer was prone to scorching when heated above 270° F. by infrared energy, and the veneer was subject to checking, i.e., cracking in fissures of dry wood, as a result of rapid removal of water from the veneer.

In an attempt to address scorching and checking, other veneer dryers were designed for continuous feeding of veneer panels through a vacuum chamber on a moving conveyor in batches, but not in single sheets. For example, U.S. Pat. No. 4,146,973 to Steffensen et al. teaches a method of continuously feeding veneer into a chamber for heating under vacuum. By way of a veneer feed mechanism, pieces of veneer are separated and heated to 160° F. as they are being continuously fed through a chamber under vacuum at 250° F.-300° F. At lower temperatures and sub-atmospheric pressures, the dryer provides the means for quick and effective drying of veneer. However, the motion created by conveyors moving the veneer through the chamber tends to damage the veneer.

More modern prior art veneer dryers dry veneer panels by continuously conveying panels through a gas sealed drying chamber with pinch roll conveyors and exposing the panels to hot gases. For example, U.S. Pat. No. 4,439,930 to McMahon, Jr. teaches a modern form of conveyor dryer and method of operation. In addition, U.S. Pat. No. 4,215,489 to McMahon, Jr. teaches a roller dryer that incorporates pinch roller conveyors and heating with hot gas at sub-atmospheric gas pressure. In accord with the more modern dryers, the veneer is still damaged through the use of roller conveyors that squeeze the piece of veneer, which is also subject to damage by conveyor motion.

Accordingly, there is a present need for a single piece of veneer drying method and apparatus for quickly drying veneer by placing the piece of veneer in a dryer and by exposing the piece of veneer to suitable heat under vacuum, which avoids scorching, checking and mechanical damage to the veneer.

SUMMARY OF THE INVENTION

The present invention provides a drying apparatus and method for extracting moisture from a piece of veneer by vaporizing or boiling-off the moisture within the veneer through heat exposure at sub-atmospheric pressure, i.e., below standard atmospheric pressure 760 mmHg. In accordance with the method and apparatus for single sheet veneer drying, a piece of veneer is exposed to heat under vacuum. Thus, as a result, the heat-exposed piece of veneer has a uniform surface porosity as will similarly treated pieces of veneer, which can be stained and finished uniformly.

A drying apparatus is provided for drying a single piece of veneer. The drying apparatus comprises a chamber configured with a drawer that slides into the chamber. After the drawer is shuttled into the chamber, the drawer is adapted to create a seal with the drying apparatus and to withstand atmospheric pressure as a pump draws a low vacuum in the chamber in accordance with the invention. A radiant heater is provided within the drying apparatus adjacent the bottom wall of the chamber or, alternatively, adjacent the top wall of the chamber. Heat radiating from the radiant heater passes through a screen or mesh surface of the drawer to which a piece of veneer is fastened. Straps or other fasteners are used to fasten a piece of veneer to the surface of the screen or mesh on the side of the screen or mesh opposite the radiant heater unless the drying apparatus is configured with two radiant heaters. Another suitable fastener is a second layer of mesh connected by a hinge to the frame of the drawer, which is used to fasten the veneer with a sandwiching action to the mesh surface of the drawer. The drying apparatus is insulated to focus heat radiating from radiant heater on a surface of the veneer. Radiant heater and pump have sufficient capacity to complete drying of a piece of veneer in five minutes.

Sensors and instruments are used to measure the vacuum pressure and temperature within the chamber and the temperature of a piece of veneer, all of which enables improved control and monitoring of the drying process.

A method of drying a piece of veneer is provided for drying a single piece of veneer. The method comprises the steps of placing a piece of veneer on a layer of mesh of the drawer of the drying apparatus, securing the piece of veneer with at least one fastening device to the layer of mesh, placing veneer fastened to the layer of mesh of the drawer in the chamber of the drying apparatus with a seal, drawing a vacuum on the chamber with a pump, and directing heat at the veneer to raise the temperature of the veneer to less than 160° F. The pump is used to lower the boiling point of water within the veneer exposed to heat for a prescribed time period for drying. Thereafter, dried veneer is withdrawn from the chamber.

Radiant heat is directed at the veneer to raise the temperature of the veneer to between 120° F. and 150° F. A suitable vacuum pressure and temperature of the veneer are selected to cause the removal of substantially all moisture from the veneer. Additionally, the drying is completed in less than five minutes with selected vacuum pressure and temperature of the veneer.

In accordance with the invention, the drying apparatus and method of use for drying may be utilized to dry materials other than veneer. Any products requiring drying such as tobacco and food products may be dried in accordance with the drying apparatus and method of the present invention.

DESCRIPTION OF THE EMBODIMENTS OF THE INVENTION

Figure 1:
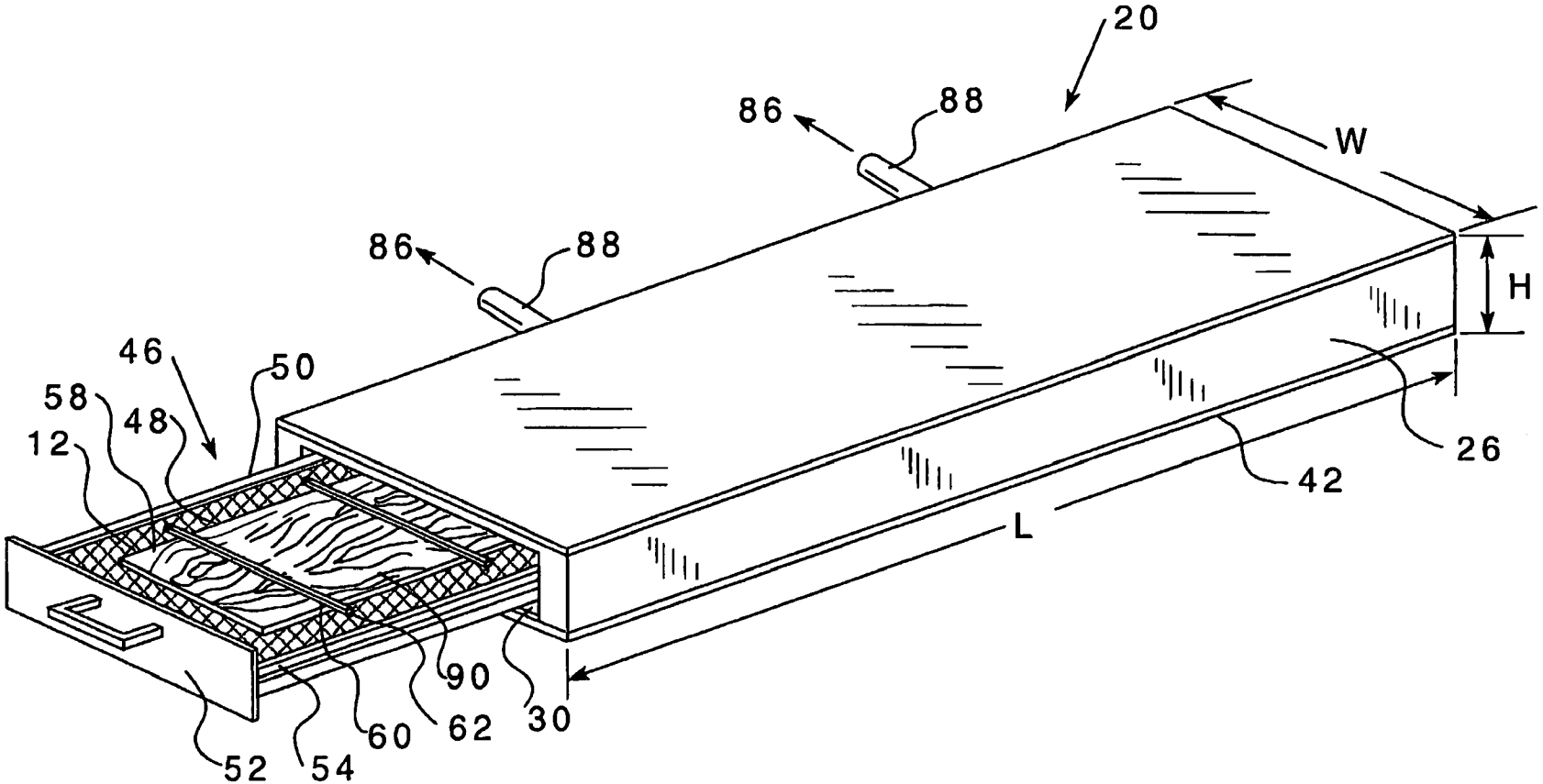
FIG. 1 is a perspective view of a partially opened drying apparatus according to the invention.
Figure 2:
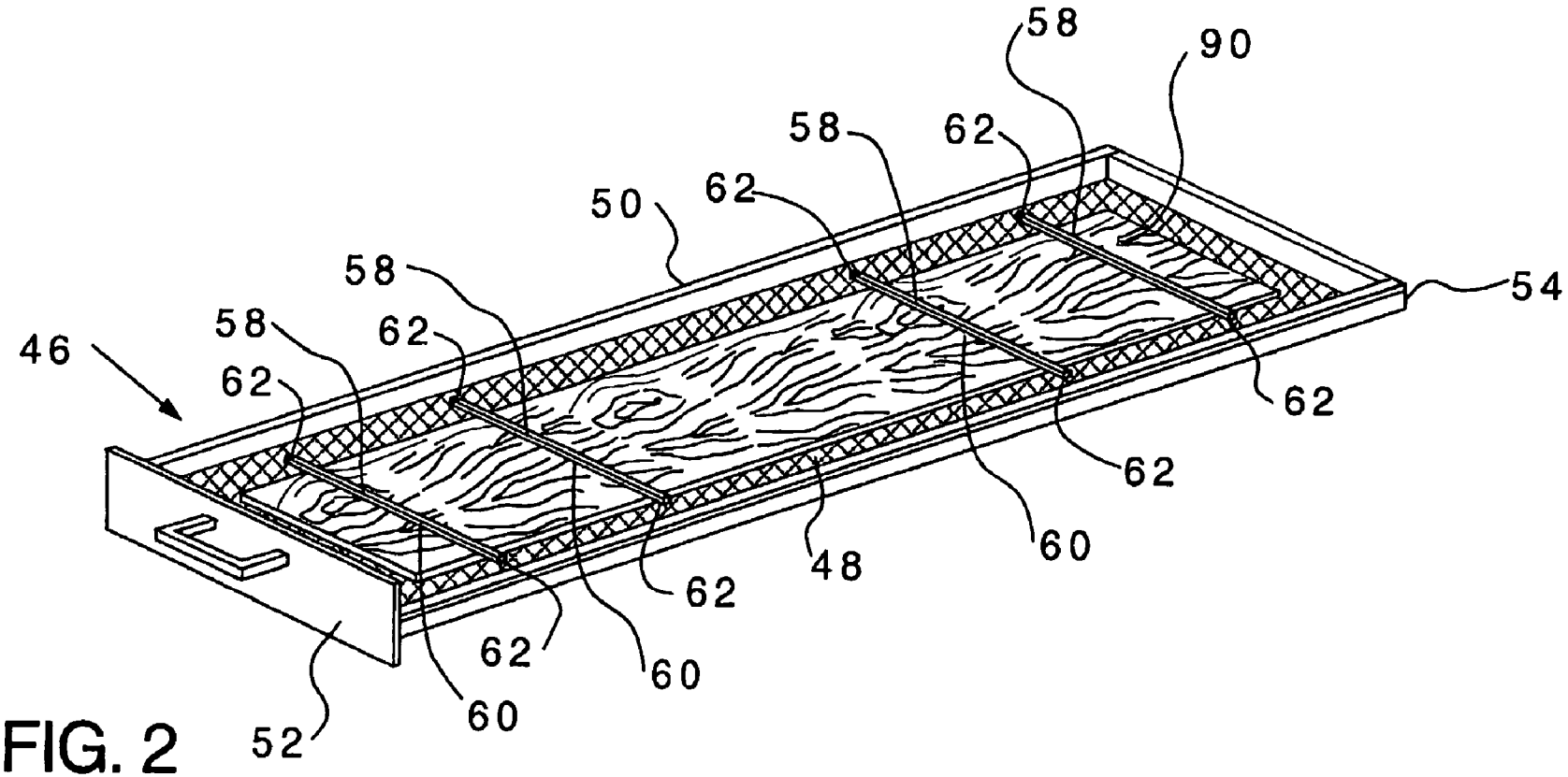
FIG. 2 is a perspective view of a drawer of the drying apparatus shown in FIG. 1.

While this invention is satisfied by embodiments in many different forms, shown in the drawings and herein described in detail are the embodiments of the invention, with the understanding that the present disclosure is to be considered as exemplary of the principles of the invention and is not intended to limit the invention to the embodiments illustrated. Various other modifications will be apparent to and readily made by those skilled in the art without departing from the scope and spirit of the invention. The scope of the invention will be measured by the appended claims and equivalents. In FIGS. 1 through 8, similar reference characters refer to similar parts throughout the several views of a drying apparatus 20 and method of use thereof. The word "item" as used in this disclosure and claims includes pieces of veneer, tobacco, foodstuff or any other item that requires drying prior to use. Additionally, although the word "veneer" is used in the disclosure and the claims as the primary item to be dried with this invention, any item can be dried by the drying apparatus and method of use thereof of this invention.

Generally, in reference to FIGS. 1 through 8, a drying apparatus 20 for drying a single piece of veneer 90 or other item such as tobacco or foodstuff at sub-atmospheric pressures is shown. The drying apparatus 20 is a chamber 24 with a drawer 46 that has a door 52 capable of creating a sealed closure with the chamber 24. A layer of mesh 48 of the drawer 46 is provided to place a piece of veneer 90 for drying with a radiant heater 82 placed inside of the chamber 24. The chamber 24 is insulated to focus the heat radiating from the radiant heater 82. Enhanced by frames 66,74, the structural stability of the chamber 24 is capable of withstanding atmospheric pressure when a vacuum is drawn on the chamber 24 with a pump 86. The pump 86 is fitted with the chamber 24 to create a sub-atmospheric pressure in the chamber 24 when drying a piece of veneer 90 with heat from the radiant heater 82. The drying apparatus 20 is designed to dry a single piece of veneer 90 at one time in approximately five minutes or less.

Referring to FIGS. 1 and 3 through 8, the chamber 24 of the drying apparatus 20 is illustrated. The chamber 24 is defined by a first side wall 26, a second side wall 28, a back wall 30, a front wall 32 with an opening 34, a top wall 38 and a bottom wall 42, which are joined in an airtight manner with suitable materials known to a skilled artisan. The height H of the chamber 24 is relatively short in comparison to the longer width W and much longer length L, which are configured to accommodate the size of a piece of veneer 90 to be dried. The materials used to construct the chamber 24 have a structural capability to withstand sub-atmospheric pressure when a vacuum is drawn in the chamber 24 by a pump 86.

Two pipe frames 66,74 are configured inside the chamber 24 to provide structural stability to the chamber 24 and the drying apparatus 20 as a whole. The pipe frames 66,74 are comprised of two long pipes 68,68' and 76,76' that run approximately the length L of the chamber 24. Sets of cross pipes 70,70' and 78,78' slightly smaller than width W connect the long pipes 68,68' and 76,76', respectively, across the width W of the drying apparatus 20. The first or "upper" pipe frame 66 is positioned adjacent the inner surface 36 of the top wall 38 of the drying apparatus 20. A second or "lower" pipe frame 74 is positioned adjacent the inner surface 40 of the bottom wall 42 of the drying apparatus 20. The "upper" pipe frame 66 is fastened to the top wall 38 of the drying apparatus 20, and the "lower" pipe frame 74 is fastened to the bottom wall 42 of the drying apparatus 20. The pipe frames 66,74 may be welded or secured by fasteners. Alternatively, the frames can be constructed of any suitable structural members such as angles or channels.

Referring to FIGS. 1, 2, 4 and 8, the drawer 46 of the drying apparatus 20 is shown. The drawer 46 is a layer of mesh 48 attached to a rectangular frame 50 with a door 52 or other expanded metal support surface. The drawer 46 is capable of sliding through the opening 34 of the front wall 32 of the drying apparatus 20, and the door 52 of the drawer 46 is capable of creating an airtight seal with the front wall 32 of the drying apparatus 20 when closed. Sliding brackets 54, guides or rails engage the rectangular frame 50 to fasten the drawer 46 to the inner surfaces 25,27 of the side walls 26,28 of the drying apparatus 20. Sliding brackets 54, guides or rails facilitate the placement of the drawer 46 in the chamber 24 of the drying apparatus 20. The layer of mesh 48 of the drawer 46 can be a screen or any other suitable material capable of withstanding heat from the radiant heater 82 and allowing heat to pass through. Essentially, the layer of mesh 48 is designed to minimize contact with the surface of a piece of veneer 90. In one embodiment, the layer of mesh 48 is epoxy-coated stainless steel.

The drawer 46 functions as a support for a piece of veneer 90 or other item while being dried in accordance with the invention. Fasteners 58 are provided to hold the piece of veneer 90 or other item to the drawer 46 to prevent warping. Fasteners 58 can be straps 60 with hooks 62 that engage the layer of mesh 48 of the drawer 46. Other types of fasteners 58 may be used and are known to those skilled in the art. In particular, a second layer of mesh connected with a hinge to the rectangular frame 50 of the drawer 46 can be used to sandwich the veneer 90 against the layer of mesh 48. With use of straps 60 and hooks 62 or, alternatively, a second layer of mesh, a piece of veneer 90 is not squeezed and distorted when fastened to the layer of mesh 48 of the drawer 46.

Figure 7:
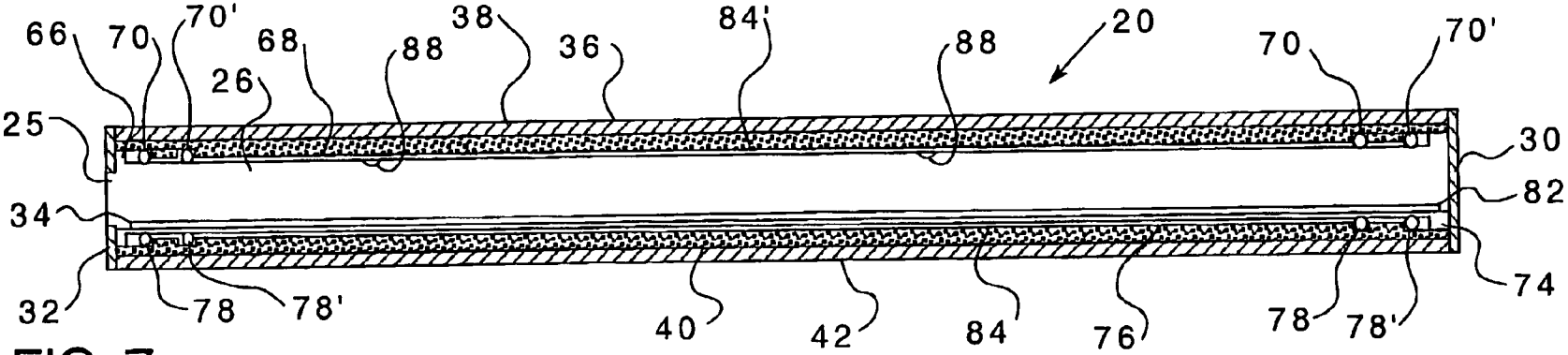
FIG. 7 is a sectional side view of the drying apparatus shown in FIG. 1 with the drawer removed.
Figure 8:
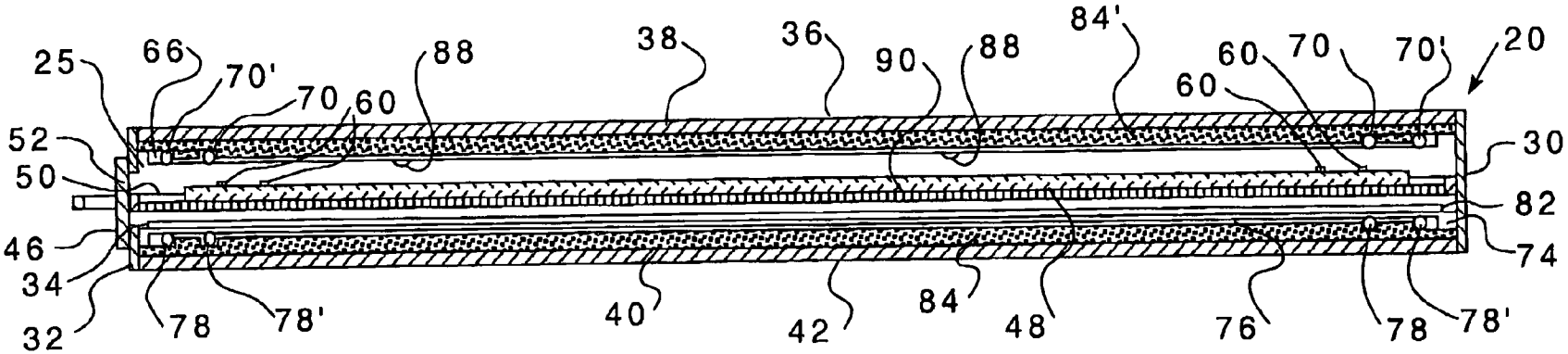
FIG. 8 is a sectional side view of the drying apparatus shown in FIG. 3 with a piece of veneer strapped to the layer of mesh of the drawer.

Referring to FIGS. 7 and 8, the radiant heater 82 of the drying apparatus 20 is illustrated as a flat panel, radiant heating element. The radiant heater 82 is placed in the bottom of the chamber 24 and is spaced just above a layer of insulation 84 abutting the inner surface 40 of the bottom wall 42 of the drying apparatus 20. Optionally, a layer of insulation 84' abuts the inner surface 36 of the top wall 38 of the drying apparatus 20. The layers of insulation 84,84', such as fiberglass batting, are fixed to the inner surfaces 36,40 of the drying apparatus 20. While shown in FIG. 8 positioned between the drawer 46 and the bottom wall 42, the radiant heater 82 can be positioned between the drawer 46 and top wall 38 of the drying apparatus 20. Furthermore, more than one radiant heater 82 may be utilized in the drying apparatus 20.

Ports 88 are provided through a side wall 26 of the drying apparatus 20 to connect a pump 86 to the drying apparatus 20. Any pump 86 capable of placing a vacuum on the chamber 24 at sub-atmospheric pressure is suitable and also known by a skilled artisan. The pump 86 may include a condenser for recovering the effluent from the chamber 24 during drying operations.

Figure 3:
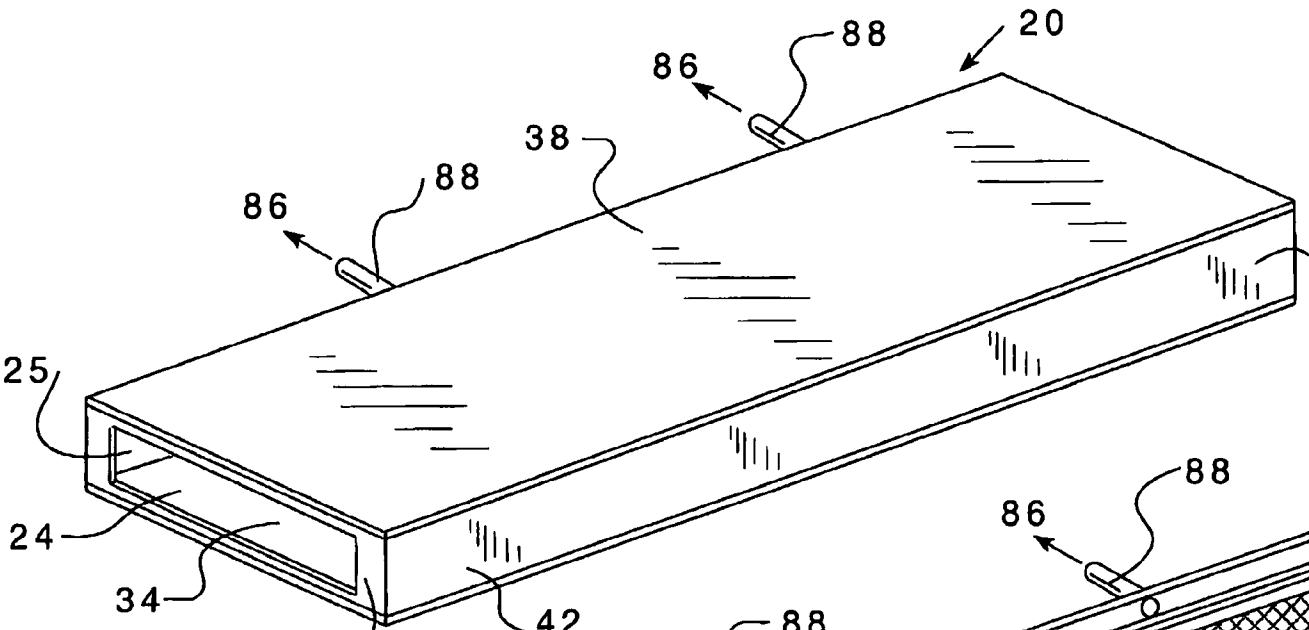
FIG. 3 is a perspective view of the drying apparatus shown in FIG. 1 without the drawer.
Figure 4:
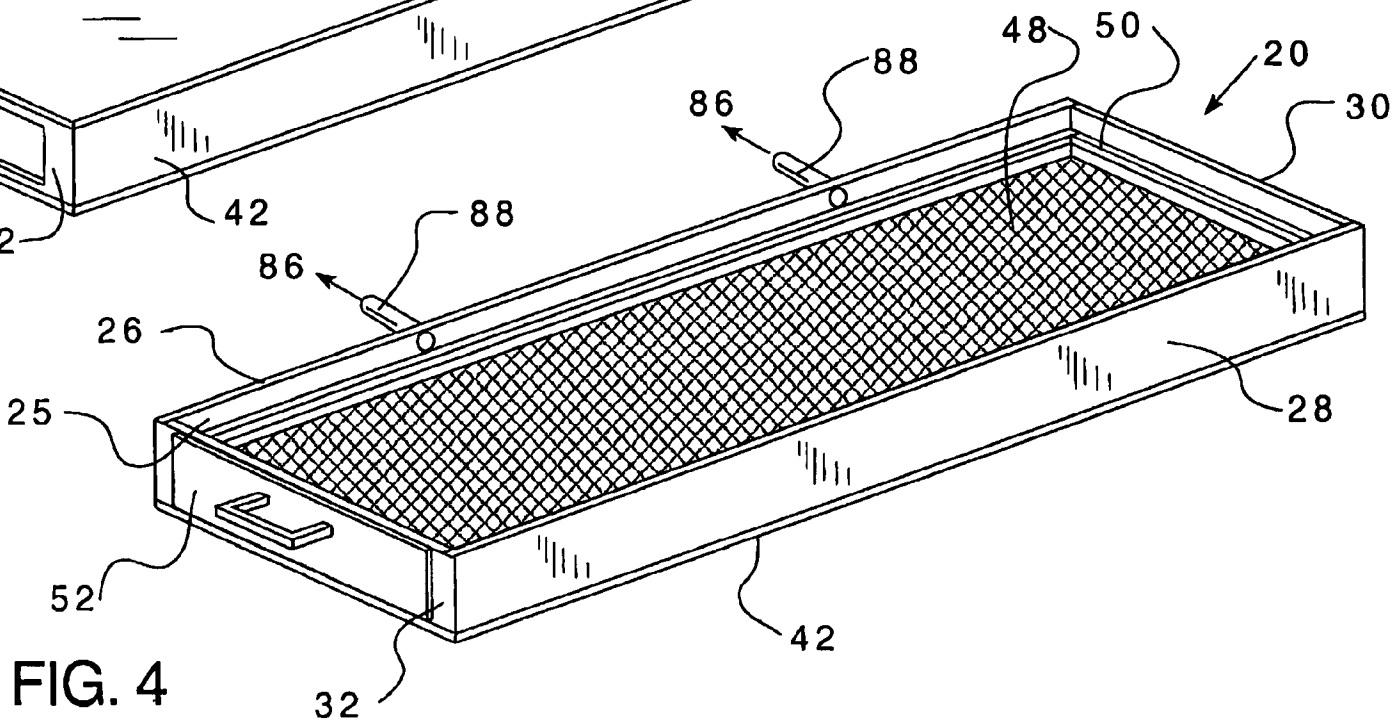
FIG. 4 is a perspective view of the drying apparatus shown in FIG. 1 with the top wall, the layer of insulation and the upper pipe frame removed.
Figures 5, 6:
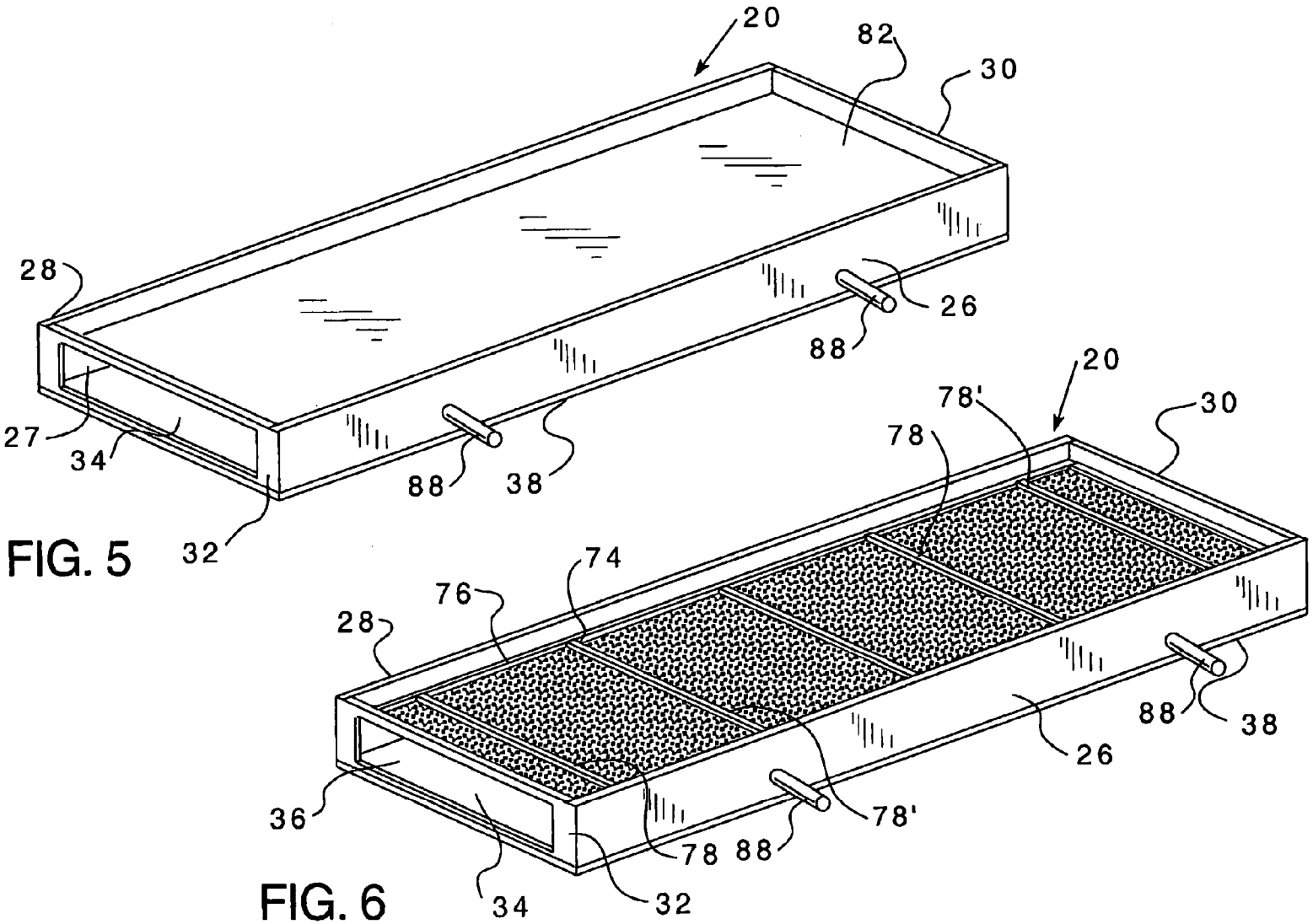
FIG. 5 is a perspective view of the drying apparatus shown in FIG. 1 inverted with the bottom wall, the layer of insulation and the lower pipe frame removed.
FIG. 6 is a perspective view of the drying apparatus shown in FIG. 1 with a layer of insulation and the lower pipe frame installed.

FIGS. 3 to 6 illustrate the drying apparatus 20 in various stages of assembly. The drying apparatus 20 is shown in FIG. 3 without the drawer 46. Absent the top wall 38 and the layer of insulation 84', the chamber 24 is shown in FIG. 4 exposing the layer of mesh 48 of the drawer 46 in a closed position with the drying apparatus 20. With drying apparatus 20 inverted in FIG. 5 without the bottom wall 42, the radiant heater 82 is shown positioned inside the chamber 24 of the drying apparatus 20. Additionally, with the drying apparatus 20 inverted in FIG. 6 without the bottom wall 42, the lower frame 74 and the layer of insulation 84 are shown positioned inside the chamber 24 of the drying apparatus 20.

No particular orientation of the chamber 24 is essential. The chamber 24 may take multiple forms and designs. As illustrated, the large flat face comprising the bottom wall 42 is shown in a horizontal position. However, there is no reason that the bottom wall 42 could not be placed nearly vertical or somewhere therebetween. The height H of the drying apparatus 20 is minimized to reduce the volume that must be evacuated to form the desired level of vacuum and is at least large enough to accommodate the layers of insulation 84,84', the radiant heater 82 and the drawer 46. Although only one design of drawer 46 is shown in the figures, any other structure or method of placing the piece of veneer 90 into the chamber 24 may be utilized. Skilled artisans should understand that conductive, although less preferred, and convective heat sources may be utilized.

In accordance with the invention, a method of drying a piece of veneer 90 or other item with the drying apparatus 20 is provided. The method of drying a piece of veneer 90 or other item includes the steps of placing the piece of veneer 90 on the layer of mesh 48 of a drawer 46 of a drying apparatus 20, securing the piece of veneer 90 to the layer of mesh 48 with at least one fastener 58, closing the drawer 46 within the chamber 24 of drying apparatus 20 with an airtight seal, drawing a vacuum on the chamber 24 with a pump 86, directing heat at the piece of veneer 90 to raise the temperature of the veneer 90 to less than 160° F., and removing a substantially dry piece of veneer 90 from the chamber 24. Essentially with the method, moisture is drawn out of a piece of veneer 90 by vaporizing or boiling-off the moisture within the piece of veneer 90 with heat from the radiant heater 82.

Referring to FIG. 1, the method includes placing the piece of veneer 90 on the layer of mesh 48 of the drawer 46 of the drying apparatus 20 and securing the piece of veneer 90 with at least one fastener 58, such as straps 60 with hooks 62 or, alternatively, a second layer of mesh, to the layer of mesh 48 of the drawer 46. Once the piece of veneer 90 is secured to the layer of mesh 48, the method requires placing the drawer 46 within the chamber 24 of the drying apparatus 20. Sliding brackets 54, guides or rails facilitate the placement of the drawer 46 within the chamber 24. The drying apparatus 20 is closed when the drawer 46 is placed fully inside the drying apparatus 20. In the closed position, an airtight seal exists between the door 52 of the drawer 46 and the front wall 32 of the drying apparatus 20.

A further step of the method of the invention involves drawing a vacuum on the sealed chamber 24 of the drying apparatus 20. A pump 86 is connected with ports 88 to the chamber 24. The pump 86 creates a vacuum in the chamber 24 at sub-atmospheric pressures, which facilitates drying the piece of veneer 90 much quicker than at standard atmospheric pressure.

A further step of the invention is directing heat at the piece of veneer 90 in order to raise the temperature of the piece of veneer 90 to less than 160° F. Particularly, the temperature of the piece of veneer 90 is between 120° F. to 150° F. The vacuum and the heat within the chamber 24 of the drying apparatus 20 cause substantially all of the moisture in the piece of veneer 90 to be removed from the piece of veneer 90 exposed to the heat radiating from the radiant heater 82. In one embodiment, substantially all of the moisture is removed from the piece of veneer 90 in less than five minutes. Once the piece of veneer 90 is substantially dried, the method involves removing the piece of veneer 90 from the chamber 24 for staining and finishing.

During the step of directing radiant heat at the surface of the piece of veneer 90, optional sensors configured with the drying apparatus 20 monitor intra-chamber pressure and temperature and also the temperature of the piece of veneer 90 being dried. The sensors are any suitable sensing mechanism capable of performing measurements of pressure and temperature and are known by skilled artisans.

As a result of treatment with the method, the piece of veneer 90 has a surface with a uniform porosity that will stain and finish uniformly. Additionally, multiple pieces of veneer 90 dried by the method will have surfaces with a uniform porosity that will also stain and finish uniformly.

The invention claimed is:

1. A method of drying an item, the method comprising the steps of:

placing the item on a layer of mesh of a drawer of a drying apparatus;

securing the item to the layer of mesh with at least one fastener;

placing the drawer within a chamber of the drying apparatus with an airtight seal;

drawing a vacuum on the chamber with a pump;

directing heat at the item to raise the temperature of the item to less than 160° F.; and removing the item substantially dried from the chamber.

2. The method according to claim 1, wherein the drying apparatus comprises a chamber capable of sealed closure with a door of a drawer with a layer of mesh adapted to slide into the chamber in a position substantially parallel to a heating element adjacent a wall inside of the chamber.

3. The method according to claim 1, wherein the item is heated to a temperature between 120° F. and 150° F.

4. The method according to claim 1, wherein sensors are provided to monitor the vacumri pressure and temperature in the chamber and temperature of the item.

5. The method according to claim 1, wherein the vacuum and heat directed at the item are selected to cause substantially all moisture removal from the item.

6. The method according to claim 5, wherein directing heat at the item completes the substantially all moisture removal from the item in less than five minutes.

* * * * *

UNITED STATES PATENT AND TRADEMARK OFFICE

CERTIFICATE OF CORRECTION

PATENT NO. : 7,383,643 B2
APPLICATION NO. : 11/088226
DATED : June 10, 2008
INVENTOR(S) : Blankenship et al.

It is certified that error appears in the above-identified patent and that said Letters Patent is hereby corrected as shown below:

Title Page, Item (54) the title, "METHOD FOR DRYING VENEERS" should read -- METHOD AND APPARATUS FOR DRYING MATERIALS INCLUDING VENEERS --

Column 6, Line 58, Claim 4, "vacumri pressure" should read -- vacuum pressure --

Signed and Sealed this

Eleventh Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,383,643 B2
APPLICATION NO. : 11/088226
DATED : June 10, 2008
INVENTOR(S) : Blankenship et al.

It is certified that error appears in the above-identified patent and that said Letters Patent is hereby corrected as shown below:

Title Page, Item (54) and Column 1, line 1, the title, "METHOD FOR DRYING VENEERS" should read
-- METHOD AND APPARATUS FOR DRYING MATERIALS INCLUDING VENEERS --

Column 6, Line 58, Claim 4, "vacumri pressure" should read -- vacuum pressure --

This certificate supersedes the Certificate of Correction issued November 11, 2008.

Signed and Sealed this

Ninth Day of December, 2008

JON W. DUDAS
*Director of the United States Patent and Trademark Office*